United States Patent [19]

Slye et al.

[11] Patent Number: 4,737,116

[45] Date of Patent: Apr. 12, 1988

[54] IMPEDANCE MATCHING BLOCK

[75] Inventors: Bradley D. Slye, Golden Valley; David A. Johnson, Minneapolis, both of Minn.

[73] Assignee: Micro Component Technology, Inc., St. Paul, Minn.

[21] Appl. No.: 854,331

[22] Filed: Apr. 21, 1986

[51] Int. Cl.[4] ..... H01R 13/66

[52] U.S. Cl. ..... 439/92; 439/607

[58] Field of Search ..... 339/14 R, 143 R, 147 R, 339/218 M; 174/117 FF; 439/92, 607–610, 620

[56] References Cited

U.S. PATENT DOCUMENTS 3,205,295 9/1965 Davidson ..... 339/14 R
3,550,065 12/1970 Phillips ..... 339/143 R X
3,621,444 11/1971 Stein ..... 339/14 R
4,431,251 2/1984 Krantz ..... 339/143 R
4,457,574 7/1984 Walters ..... 339/143 R

*Primary Examiner*—Z. R. Bilinsky
*Attorney, Agent, or Firm*—Lawrence M. Nawrocki

[57] ABSTRACT

An impedance matching block (16, 42, 92) for multi-pin connectors (10, 36, 104). A male connector member (12, 38) carrying signal male pins (18, 20) is mated to a female connector member (14) having signal female pins (24, 26), the male pins (18, 20) being received in corresponding female pins (24, 26). The impedance matching block (16) is interposed between male connector member (12) and female connector member (14). The block (16) is provided with impedance matching holes (32, 34) through each of which holes (32, 34) one paired combination of male and female pins (18, 20, 24, 26) passes coaxially.

6 Claims, 1 Drawing Sheet

IMPEDANCE MATCHING BLOCK

TECHNICAL FIELD

The present invention deals broadly with the field of apparatus for handling and conveying integrated circuit devices to a test site, comprising part of the apparatus, which interfaces with a tester for evaluating the quality of the integrated circuit devices. More narrowly, however, the invention relates to a multi-pin connector and, particularly, to such a connector which embodies matched impedance characteristics.

BACKGROUND OF THE INVENTION

A need exists to provide a means of impedance matching for multi-pin connectors. It is known that surrounding a signal conveyor with a ground device will effectively provide impedance matching. In the past a number of mechanical means have been designed to effect this matching in connectors. Such means including a central signal connector within a coaxial ground connector are illustrated in U.S. Pat. No. 3,596,138, and a central signal connector surrounded by a number of ground connectors is illustrated in U.S. Pat. Nos. 3,643,201 and 3,761,844.

There exists a need to provide impedance matching for connectors that have a plurality of pins mating. In automated applications, such connectors may be rapidly cycled through numerous cycles of mating and unmating. Pin alignment is critical and, for reliability, it is desirable to provide the matched impedance without unduly complicating the mechanical apparatus that must be repetitively mated and unmated. For this reason, numerous ground pins surrounding a signal pin or a mating co-axial ground plane around multiple signal pins are not deemed to be workable solutions.

SUMMARY OF THE INVENTION

It is an object of this invention to provide a multi-pin connector having matched impedance without increasing the number of mechanical components that must be mated and unmated and providing for improved pin alignment between male and female pins.

This and other objects of the invention are attained by providing an impedance matching block affixed to the component of the connector that supports one set of pins, preferably the female pins. The impedance matching block is made of electrically conductive material and has a series of holes through it, at least one hole for each set of male and female pins to be mated. The block is in electrical contact with at least one of the ground pins or other source of ground potential. Each signal pin is generally centrally located with respect to a hole in the block and is spaced from the hole. The desired spacing between the signal pin and the grounding plane is found by applying the formula $b=ae^{z_o\sqrt{e_r}/60}$ where "b" is the desired spacing, "a" is the diameter of the signal pin, and "$z_o$" is the desired impedance. "$e_r$" is the dielectric constant of the medium between the conducting plates, which are in this case the signal pin and the block surrounding the signal pin. The medium, it is intended, is air.

The above relationship yields a hole size that is effective in providing the desired impedance matching for a given pin size. Where the center line of the signal pins must necessarily be set closer together than one diameter of the hole size necessary to provide the desired impedance, it has been found that it is possible to overlap such holes, thereby joining the holes and forming a serration between adjacent holes, without significantly degrading the impedance matching. By suitable selection of the hole overlap and the serration depth, it has been found that the majority of the flux lines from a given pin will go to the serration between it and the adjacent pin as opposed to going to the adjacent pin and thereby causing undesirable crosstalk between adjacent signal pins.

DETAILED DESCRIPTION OF THE INVENTION

Figure 1:
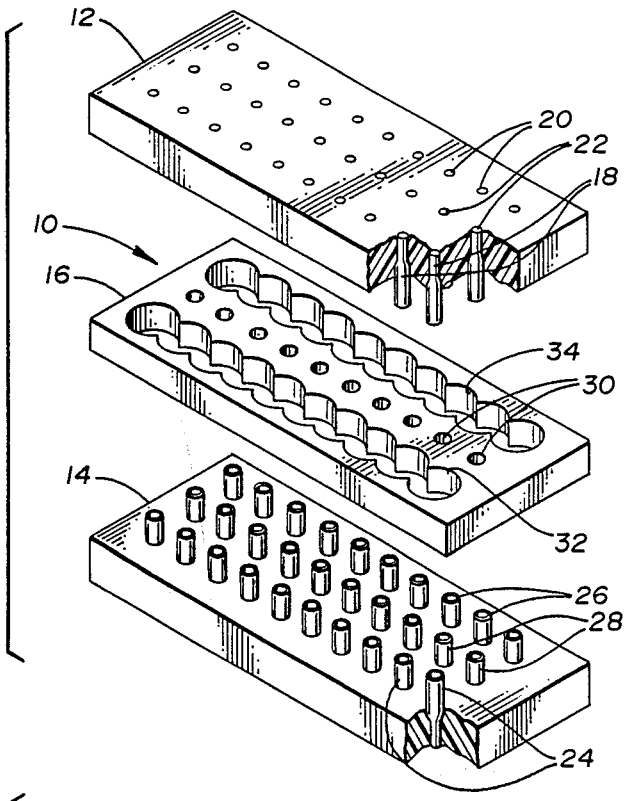
FIG. 1 is a perspective view of a preferred embodiment of the invention, showing the block suspended between, and aligned with, the pins of both the male connector componet and the female connector component.

FIG. 1 shows a separated multi-pin connector generally at 10. The male connector member is indicated at 12 and the female connector member is at 14. Block 16 is shown between male connector member 12 and female connector member 14.

In a preferred embodiment, male connector member 12 is made of an electrically non-conductive material and has three pin rows shown as signal male pin rows 18 and 20 on either side of ground male pin row 22. Each pin in pin rows 18, 20 and 22 is affixed in and supported by, male connector member 12 and protrudes from male connector member 12 in a downward direction. The upper end of each pin in signal male pin rows 18 and 20 is electrically connected, as by soldering, to a suitable source of electrical signals. The upper end of each pin in ground male pin row 22 is electrically connected, as by soldering, to a source that is at electrical ground potential.

Female connector member 14 is also made of electrically non-conductive material and has three rows of female pins, signal female pin rows 24 and 26 and ground female pin row 28. Each pin in pin rows 24, 26 and 28 is affixed in, and supported by, female connector member 14 and protrudes from female connector member 14 in an upward direction. The lower end of each pin in signal female pin rows 24 and 26 is electrically connected, as by soldering, to leads for the transmission of electric signals. The lower end of each pin in ground female pin row 28 is electrically connected, as by soldering, to leads for the transmission of electrical ground potential. There is a female pin in female conector member 14 that is axially aligned with, and is for mating with, each male pin in male connector member 12.

In a preferred embodiment, block 16 is made of an electrically conductive material and has ground pin hole row 30, with a hole axially aligned with each pin in ground female pin row 28. Preferably, the diameter of each such hole is only slightly greater than the diameter of the pin with which it is axially aligned in ground female pin row 28. The resulting close tolerances between the holes in ground pin hole row 30 and the pins in ground female pin row 28 result in a press fit between block 16 and female connector member 14 when block 16 and female connector member 14 are joined. Such a press fit makes an electrical connection between grounding block 16 and the pins of ground female pin row 28, thereby ensuring that they are of the same electrical potential. Additionally, the press fit provides physical support for the pins of ground female pin row 28 by block 16, thereby assisting in maintaining the axial alignment of such pins with the pins of ground male pin row 22.

Paralleling and on either side of ground pin hole row 30, are impedance matching hole rows 32 and 34. An impedance matching hole is provided for, and axially aligned with, each pair of male and female pins on male connector member 12 and female connector member 14. Each impedance matching hole is spaced from its respective pin a distance suitable to provide the desired impedance matching.

For compactness, it is desirable, in the preferred embodiment shown, to have pins in signal male pin rows 18 and 20 and the pins in signal female rows 24 and 26 closer together than permits providing a separate impedance matching hole for each pair of male and female signal pins for the desired impedance. This occurs where the desired impedance mandates an impedance matching hole of diameter greater than the distance between the axes of adjacent pins in the signal pin rows. The resultant structure is as shown in FIG. 1 where the impedance matching holes of impedance matching hole rows 32 and 34 overlap creating, in effect, a continuous slot with opposing serrations interposed half the distance between the axes of adjacent impedance matching holes. It has been found that such overlap does not significantly degrade the impedance matching effect of the impedance matching holes but does substantially reduce crosstalk between adjacent signal pins.

Figure 2:
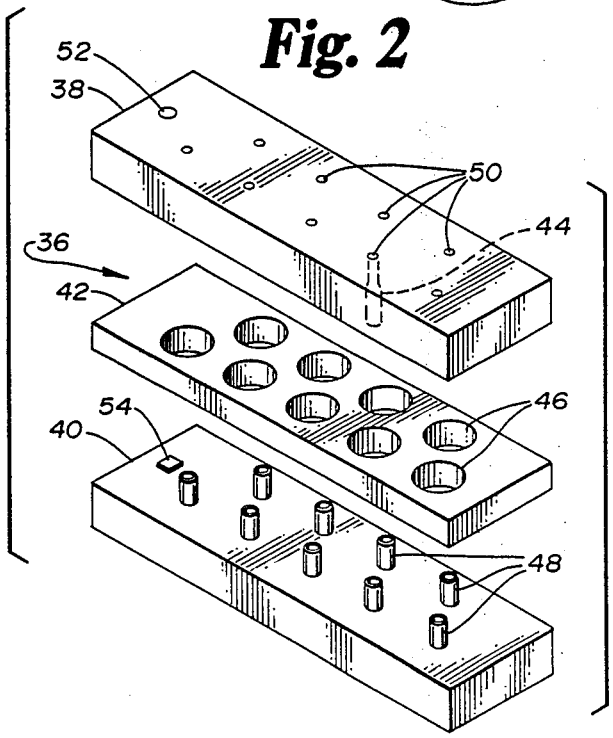
FIG. 2 a view similar to that of FIG. 1 illustrating another embodiment of the block providing an impedance for each signal pin.

FIG. 2 shows generally at 36 another embodiment of a multi-pin connector with two marked variations from the embodiment shown in FIG. 1. First, there are no ground pins in male connector member 38 or female connector member 40 and, consequently, no need for ground pin holes in block 42. Secondly, male signal pins 44 are spaced from each other sufficient distances to permit non-overlapping impedance matching holes 46 to be bored in block 42.

Each male signal pin 44 is paired with, and axially aligned with, a female signal pin 48 in female connector member 40. Each male signal pin 44 extends through male connector member 38 and may be connected at electrical connections 50 to electrical signal transmission means. Similarly, each female signal pin 48 extends through female connector member 40 and may be connected to signal reception means at the underside of female connector member 40. In the absence of ground pins, ground potential is conveyed to block 42 by first ground strap 52 which is connected to a source of ground potential, and strap 52 extends through male connector member 38 to make electrical contact with block 42 when multi-pin connector 36 is in the connected condition. Similarly, second ground strap 54 electrically contacts block 42 and extends through female connector member 40 at a surface of which it may be connected to ground potential reception means.

Impedance matching block 42 is made of electrically conductive material. Each male signal pin 44 and its paired female signal pin 48 have a coaxial impedance matching hole 46 that is spaced therefrom a distance suitable to provide the desired impedance when multi-pin connector 36 is connected. Such impedance matching holes minimize the possibility of crosstalk between male signal pins 44. Since there are no grounding pins, grounding block 42 is afixed to either male connector member 38 or female member 40 with a suitable cement or the like. The alignment of impedance matching holes 46 coaxial with the paired male signal pins 44 and female signal pins 48 is provided for at the time of affixation.

Figure 3:
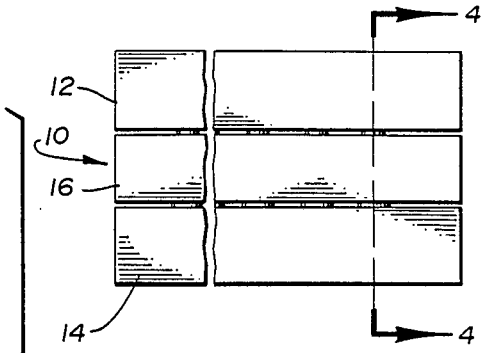
FIG. 3 is a side elevational view of the multi-pin connector in the mated position

FIG. 3 shows a multi-pin connector as shown in FIG. 1, generally at 10, in the connected condition. Grounding block 16 is closely sandwiched between male connector member 12 and female connector member 14. The height of block 16 is substantially equal to the height of each connected pair of male and female signal pins between male connector member 12 and female connector member 14. As shown in table 1, as long as the height of the block 16 substantially equals the connected pin height, the grounding block is effective to match the impedance. In table 1, the impedance to be matched was 50 ohms.

TABLE 1

| | |
|---|---|
| Long pins, no grounding block | 73 ohms |
| Long pins, grounding block | 55 ohms |
| Short pins, no grounding block | 70 ohms |
| Short pins, grounding block | 52 ohms |

Figure 4:
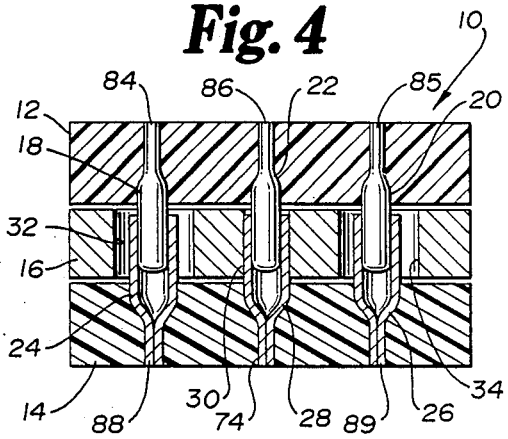
FIG. 4 is a view of the multi-pin connector in the mated position taken generally along line 4—4 in FIG. 3.

FIG. 4 shows, in section, a multi-pin connector as shown in FIG. 1 generally at 10. Multi-pin connector 10 is shown in the connected position. Block 16 is press fit to female connector member 14 by the close tolerance of ground pin hole 30 and female ground pin 28. Female ground pin 28 extends through female connector member 14 and may be connected to ground potential reception means at electrical connection 74. The press fit also provides for electrical connection of female ground pin 28 and block 16.

Male connector member 12 is electrically and physically joined with female connector member 14 by mating the male pins with the female pins. Specifically, male signal pins 18, 20 are mated with female signal pins 24, 26 and male ground pins 22 are mated with female ground pins 28. Male signal pins 18, 20 extend through male connector member 12 and may be suitably electrically connected to signal sources at electrical connections 84, 85. Male ground pins may be similarly connected to a source of ground potential at electrical connection 86. Female signal pins 24, 26 may be connected to signal transmission means at electrical connections 88, 89.

Turning to impedance matching block 16, it can be seen that its height is substantially equal to the height of the mated pair of male signal pins 18, 20 and female signal pins 24, 26 as measured between the bottom of male connector member 12 and the top of female connector member 14. Impedance matching holes 32, 34 are coaxial with, and spaced from, their respective mated pair of male signal pins 18, 20 and female signal pins 24, 26. The spacing provides the desired impedance.

Figure 5:
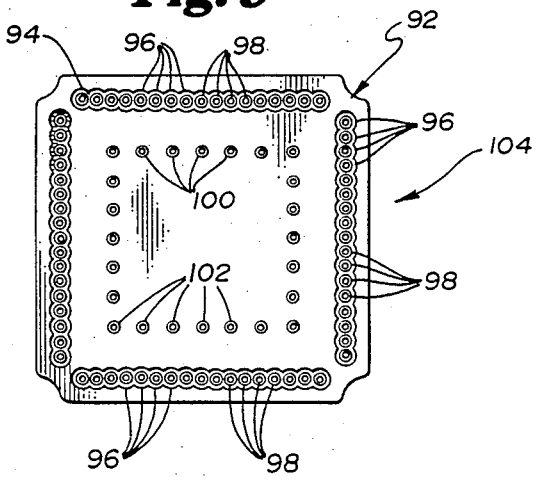
FIG. 5 is a top view of an alternative embodiment showing the female connector member with the grounding block in place in an overlying relationship.

FIG. 5 shows a top view of a multi-pin connector 104 with the impedance matching block 92 affixed to female connector member 94, visible only through impedance matching holes 96 and around female signal pins 98. Impedance matching block 92 is press fit to female connector member 94 by the close tolerance of ground pin holes 100 and ground pins 102. The embodiment of FIG. 5 employs grounding pins defining a square configuration and can be used when testing integrated circuits having contacts along four edges thereof. The press fit provides for electrical connection of ground pins 102 and impedance matching block 92, thus ensuring that impedance matching block 92 is at ground potential. the desired impedance matching. In this embodiment, adjacent impedance matching holes 96 overlap creating, in effect, a continuous slot with opposing serrations interposed half the distance between the axes of adjacent impedance matching holes 96.

Not shown in FIG. 5 is the male connector member, which would be similar in shape to female connector member 94 and have a male signal pin paired with each female signal pin 98 and a male ground pin paired with each female ground pin 102.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is

1. A multi-pin connector having impedance matching means, comprisng:

(a) a first connector member having multiple male pins therein;

(b) a second connector member having multiple female pin therein, each female pin corresponding to a male pin for mating therewith; and (c) impedance matching means interposed between the first and second members, said means constructed of electrically conductive material, being at ground electrical potential, and having a plurality of impedance matching bores formed therethrough, each impedance matching bore being coaxial with a corresponding pair of male and female pins with repect to which impedance matching is desired and being spaced therefrom to provide a desired impedance;

(d) wherein the impedance matching bores thorugh the impedance matching means overlap and join one another to define opposed serrated-like edges.

2. A multi-pin connector as set forth in claim 1, wherein an axial dimension of the impedance matching means is substantially equal to the dimension of the mated male and femate pins as measured between the first and second connector members.

3. Impedance matching means for use with an electrical connector, the electrical connector having a pluality of male electrical signal connector pins projecting from a first member and a plurality of female electrical signal connector pins projecting from a second member, each female electrical signal connector pin being matable with a corresponding male electrical signal connector pin and coaxial therewith to convey an electrical signal other than ground electrical potential therethrough when the first and second members are joined together; wherein the impedance matching means is an electrically conductive block at ground electrical potential and has a plurality of impedance matching bores formed therethrough, each bore being coaxial with, and spaced from, a corresponding pair of mated male and female electrical signal connector pins; wherein the impedance matching bores overlap with adjacent impedance matching bores to define a pair of opposing edges.

4. Impedance matching means for use with an electrical connector, the electrical connector having a plurality of male electrical signal pins and at least one male electrical ground pin projecting from a first member, and female electrical signal pins and at least one female electrical ground pin projecting from a second member, each female electrical signal pin corresponding to, for connection with, one of the male electrical signal pins and being coaxial with the corresponding male pin to convey an electrical signal other than ground potential, and the female electrical ground pin corresponding to, for connection with, the male electrical gound pin and being coaxial therewith when the first and second members are joined together; wherein the impedance matching means is constructed of electrically conductive material and has a bore therethrough corresponding to, and being coaxial with, the pair of connected male and female electrical ground pins, the bore being in physical and electrical contact with the female electrical gound pin to align the corresponding male and female electrical signal pins, and to place the impedance matching means at electrical ground potential; and wherein the impedance matching means has an impedance matching bore coaxial with, and spaced from, each pair of male and female electrical signal pins; wherein each impedance matching bore overlaps with adjacent impedance matching bores to define a pair of opposing serrations therebetween.

5. A multi-pin connector having impedance matching means, comprising:

(a) a first connector member having multiple male pins therein;

(b) a second connector member having multiple female pins therein, each female pin corresponding to a male pin for mating therewith; and (c) impedance matching means interposed between the first and second members, said means constructed of electrically conductive material, being at ground electrical potential, and having a plurality of impedance matching bores formed therethrough, each impedance matching bore having coaxial with a corresponding pair of male and female pins with respect to which impedance matching is desired and being spaced therefrom to provide a desired impedance;

(d) wherein the multiple male pins comprise a plurality of male signal pins and a plurality of male ground pins, and the multiple female pins comprise a plurality of female signal pins and female ground pins, each male signal pin being paired with a female signal pin for mating therewith, and each male ground pin being paired with a female ground pin for mating therewith, the mated male and female signal pins being those for which impedance matching is desired; the impedance matching means having a plurality of alignment bore means therethrough, each of said alignment bore means being coaxial with a corresponding female ground pin and being in close circumferential engagement therewith to provide alignment of said pairs of male and female signal pins relative to their corresponding impedance matching bores, and to provide electrical connection between at least one female ground pin and the impedance matching means.

6. A multi-pin connector as set forth in claim 5 wherein the plurality of mated male and female signal pins are arranged in at least one row having closely spaced adjacent mated male and female signal pins; the impedance matching bores of the impedance matching means being in a row and overlapping adjacent impedance matching bores and forming a serrated-like slot.

* * * * *